US006803590B2

(12) United States Patent
Brailove et al.

(10) Patent No.: US 6,803,590 B2
(45) Date of Patent: Oct. 12, 2004

(54) ION BEAM MASS SEPARATION FILTER, MASS SEPARATION METHOD THEREOF AND ION SOURCE USING THE SAME

(75) Inventors: Adam Brailove, Toyo (JP); Hirohiko Murata, Toyo (JP)

(73) Assignee: Sumitomo Eaton Nova Corporation, Tokyo (JP)

( * ) Notice: Subject to any disclaimer, the term of this patent is extended or adjusted under 35 U.S.C. 154(b) by 43 days.

(21) Appl. No.: 10/379,065

(22) Filed: Mar. 4, 2003

(65) Prior Publication Data

US 2003/0168588 A1 Sep. 11, 2003

(30) Foreign Application Priority Data

Mar. 5, 2002 (JP) ..... 2002-058966

(51) Int. Cl.[7] ..... H11J 49/00

(52) U.S. Cl. ..... 250/492.22; 250/492.21; 315/111.81

(58) Field of Search ..... 250/492.1, 492.21, 250/492.22; 315/111.81

(56) References Cited

U.S. PATENT DOCUMENTS 4,804,852 A * 2/1989 Rose et al. ..... 250/492.1
6,207,963 B1 * 3/2001 Benveniste ..... 250/492.21

* cited by examiner

*Primary Examiner*—David Vu
(74) *Attorney, Agent, or Firm*—Watts Hoffmann Co. L.P.A.

(57) ABSTRACT

A mass separation filter has a first magnet forming a first magnetic field in an orthogonal direction to a beam axis of an ion beam, a second magnet sequentially arranged with the first magnet along the beam axis, parallel with and facing the opposite direction of the first magnet, and forming a second magnetic field orthogonal to the beam axis; and a collimator wall formed within the first and second magnetic fields that forms a transfer channel from a first curved channel deflected from the first magnetic field to a second curved channel deflected by the second magnetic field in a direction the reverse of the first magnetic field. Incident ions pass through a channel inversely curved by the magnetic fields of the first and second magnets according to the mass separation filter, and it is possible to lead ions of a desired mass in the same direction as the beam axis.

33 Claims, 7 Drawing Sheets

ION BEAM MASS SEPARATION FILTER, MASS SEPARATION METHOD THEREOF AND ION SOURCE USING THE SAME

BACKGROUND OF THE INVENTION

1. Field of the Invention

The present invention relates to an ion source used in an ion implanter, and in particular, a mass separation filter for extracting ions with a desired mass provided in the ion source.

2. Related Art

An ion source generates plasma from a gas introduced into a vacuum vessel to extract as an ion beam. It is used in areas such as the introduction of impurities to semiconductors, TFT for liquid crystal, solar cells, and the like, processing through etching and sputter by an ion beam, and furthermore, in deposition and reforming by ions.

In particular, large area ion beams are greatly used in the ion implantation of semiconductors and reforming of materials, obtaining high productivity when producing products such as flat panels on a large scale.

The ion beam for a semiconductor wafer in general ion implantation is smaller than the above ion beams. This ion beam implants only one ionic species undergoing mass spectrometry onto a substrate thereof. To use a large area ion beam in this preferred method, it is necessary to increase scale across the board, but increasing the size of the device is difficult. In addition, large sector dipole magnets used for the wafer would become costly.

As a related art, there is a mass separation device disclosed in Japanese Patent Journal No. 2920847. This device, as shown in FIG. 7, includes an incidence plate 31 having a plurality of through holes 30 with mutually parallel axis lines, and an ion incidence plate 33 which is arranged in parallel with the incidence plate and has a plurality of through holes 32 with axis lines at a predetermined angle θ with respect to the axis line of the through holes of the incidence plate 31. This device is also provided with field generating means B that generates a magnetic field perpendicular to the axis lines of the respective through holes.

With this mass separation device, it is possible to simultaneously separate mass across a wide area since mass separation is performed through only a difference in the curving angle of the ions. However, in this device, the direction of ions incident to the implantation incidence plate differs the direction of the ions emitted from the ion incidence plate, therefore, the incidence direction and the emitting direction of the ion beam passing via an extraction electrode cannot be made uniform, and it is difficult to arrange the plasma electrode, extraction electrode, acceleration electrode, and ground electrode in parallel at the bottom portion of the plasma chamber to extract ions of a desired mass in a fixed direction.

Also, a mass separation system from Aitken is disclosed in the specification of European Patent No. 1090411. In this system, two dipole magnets sequentially placed along a beam axis form a quadrupole type lens. The two magnets are oriented such that their magnetic fields are not parallel and face in opposite directions perpendicular to the beam axis. This quadrupole lens forms a linear ion beam extracted from a slit in the plasma electrode, and ions linearly converge at the exit portion of the lens thereof.

Therefore, since this focus position changes according to ionic mass, mass selection becomes possible and ions with a necessary mass can be separated. However, this device requires a large space, and the beam has a long trajectory direction. The mass separation filter should prevent the beam from impinging on the internal portion of the filter and must collimate, therefore maintaining the beam in parallel is difficult. Accordingly, the space of the ribbon ion beam must be widened, and the horizontal space of the mass separation filter needs to be made larger.

Further, a mass separation filter 40 using a Wien filter that separates mass through the action of electric and magnetic fields is disclosed in Japanese Patent Laid-Open Publication No. 5-82083 (corresponding U.S. Pat. No. 5,189,303 specification). This device, as shown in FIG. 8A, has a plasma electrode 41, an extraction electrode 42, an acceleration electrode 44, and a ground electrode 45 arranged on an ion source exit side. The extraction electrode 42 at which ionic speed is at a low stage is constituted by an extraction electrode 42*a* and a mass separation electrode 43. A Wien filter 50 is respectively provided on each through hole 52 of the extraction electrode 42*a*.

Expanding a portion of the extraction electrode 42*a*, as evident in detailed views of FIG. 8, a vertical section in FIG. 8B and a horizontal section in FIG. 8C, it includes magnets 48 disposed facing each other on segmented electrode plates 46, and structures a Wien filter generating an electric field E in direction x, and a magnetic field B in direction y. Further, a mass separation electrode 43 with little voltage conforming to a position of a through hole is provided immediately rearward of the extraction electrode 42*a*, thereby enabling the mass separation of a large area ion beam. In this case, ions of a desired mass pass through holes without change, while ions with undesired masses do not pass through the through holes. In other words, ions with excessively large or small masses are eliminated, therefore resolution is high and size reduction is possible.

However, the Wien filter adds an electric field applied parallel to the beam direction to accelerate ions, and furthermore, requires an electric field perpendicular to the beam direction which generates a filtering effect through the electric field and the magnetic field. In addition, much of that plate/electrode area necessitates structures for generating the crossed electric fields and magnetic field, which limit the electrode release area relating to beam transport, therefore in addition to restricting total beam current, it is difficult to obtain satisfactory homogeneity.

SUMMARY OF THE INVENTION

In view of the foregoing situation, it is an object of the present invention to provide a mass separation filter and a mass separation method thereof, as well as an ion source using the same, in order to generate a large area ion beam from ions with a desired mass, allowing the selective rejection of unnecessary ions, in addition to simplifying and reducing the size of the electrode structure of the ion source.

In order to achieve the above-mentioned object, the present invention has a structure as described in the claims. The mass separation filter of the present invention is characterized by having a first magnet forming a first magnetic field in a direction orthogonal to a beam axis of an ion beam; a second magnet provided in series to the first magnet along the beam axis, forming a second magnetic field which is orthogonal to the beam axis and in parallel with and opposite the first magnetic field; and a collimator wall for forming a beam channel having a first and a second curved channels formed within the first and second magnetic fields such that selected ions of a desired mass can pass from the first curved channel slanted by the first magnetic field to the second curved channel which is slanted in a direction the reverse of the first magnetic field by the second magnetic field.

According to this structure, it is possible to extract ions of a desired mass from ions entering the mass separation filter and passing through a beam channel with a channel that is inversely curved by the magnetic fields of the first and second magnets, in addition to allowing the directions in which ions enter and are emitted to be identical to the direction of the beam axis.

Also, according to the first aspect of the present invention, a large area ion beam of the present invention includes a plasma chamber; means for introducing gas with a controlled flow into the plasma chamber; an energy source for ionizing the gas within the plasma chamber; a plasma electrode that forms a plasma chamber wall with an oblong opening, and extracts positive ions from the opening; an extraction electrode for setting a controllable value of the kinetic energy of the ions, and provided parallel to and with a low potential with respect to the plasma electrode in order to extract ions passing the plasma electrode; and a mass separation filter provided rearward of the plasma electrode and having a plurality of openings aligned with the extraction electrode in order to select a desired mass or a range of mass.

According to this structure, it is possible to selectively eliminate unnecessary ions, while allowing ions of a desired mass to pass along the collimator wall through the action of magnetic fields of the first and second magnets within the mass separation filter, without changing the arrangement of the electrode structure of the ion source. In addition, the structure of the mass separation filter may be formed by the collimator wall and the first and second magnets, therefore, the structure is simple. Also, control for extracting ions of a desired mass is easy because no effects are generated by the interaction of the magnetic fields and electric field since the incident ions are deflected by only the magnetic fields. Further, a beam channel is realized which curves in a shape that inverts a channel curved in one direction, therefore, it has excellent ion convergence, and enables a reduction in the size of the mass separation filter used in a large area ion beam passing through slits with a high aspect ratio.

According to a preferred embodiment of the present invention, the first and second magnets are permanent magnets, and are mounted in a metal tube through which coolant flows. In addition, the beam channel formed by the collimator wall is a substantial S-shape and not parallel to the magnetic fields. Further, the collimator wall is created from a thin metal plate or graphite, and has at least a pair of curved walls and a pair of side walls provided facing each other in order to form the first and second curved channels. In the case of graphite collimator walls, it is possible to machine solid graphite, or manufacture it from soft graphite sheets.

In addition, according to another structure of the present invention, the beam trajectory slanted by the first and second magnetic fields is structured to shift an emission opening position of the beam towards the mass separation filter with respect to the incidence opening position of the beam. The two opening positions allow the passing of the forward traveling beam, therefore, by overlapping them when viewed from the axial direction of the ion beam, unnecessary ions, electrons, and the like can be reliably separated from the ion beam.

Also, when overlapping the two opening positions, it is possible to increase the total ion beam amount passing through since the forward traveling beam renders a small opening shift amount with direct emission.

Therefore, by forming the first magnetic field orthogonal to the beam axis of the ion beam, and forming the first and second magnetic fields mutually opposite and parallel, as well as orthogonal to the beam axis, it is possible in the present invention to render the traveling direction of incident ions and emitted ions identical to the direction of the beam axis, allowing easy alignment of each electrode of the ion source. Also, in forming a curved beam channel by collimator walls structured from a curved wall and a side wall, it is possible to eliminate unnecessary ions by only allowing ions of a desired mass to pass along the collimator walls. Furthermore, unnecessary ions, electrons and the like are separated from the ion beam by adjusting the shift amount between the incidence opening position and the emission opening position of the beam channel of the ion beam, thereby allowing an increase in the total ion beam amount passing through.

Further, the mass separation method according to the present invention includes the steps of forming a first magnetic field orthogonal to a beam axis of an ion beam or forming mutually opposing and parallel first and second magnetic fields orthogonal to the beam axis; deflecting an ion beam within the magnetic fields along a curved channel formed by a collimator wall created from at least a pair curved walls and a pair of side walls provided facing each other; and passing selected ions of a desired mass while colliding forward traveling ions and unnecessary ions into the collimator wall; therefore ions with a desired mass can be selected by the curved beam channel with a simple magnet structure. In addition, ionic convergence is excellent, and it is possible to perform mass separation of a large area ion beam passing through slits with a high aspect ratio.

In addition, the structure of the mass separation filter is formed by the first and second magnets and the collimator walls, therefore, it has a simple structure. Since the incident ions are deflected by only the magnetic fields, designing a collimator that does not generate effects from the interaction of the magnetic and electric fields is easy. Further, according to the present invention, a beam channel is realized which curves in a shape that inverts a channel curved in one direction, therefore, it has excellent ion convergence, and enables a reduction in the size of the mass separation filter used in a large area ion beam passing through slits with a high aspect ratio.

DESCRIPTION OF THE PREFERRED EMBODIMENTS

Figure 1:
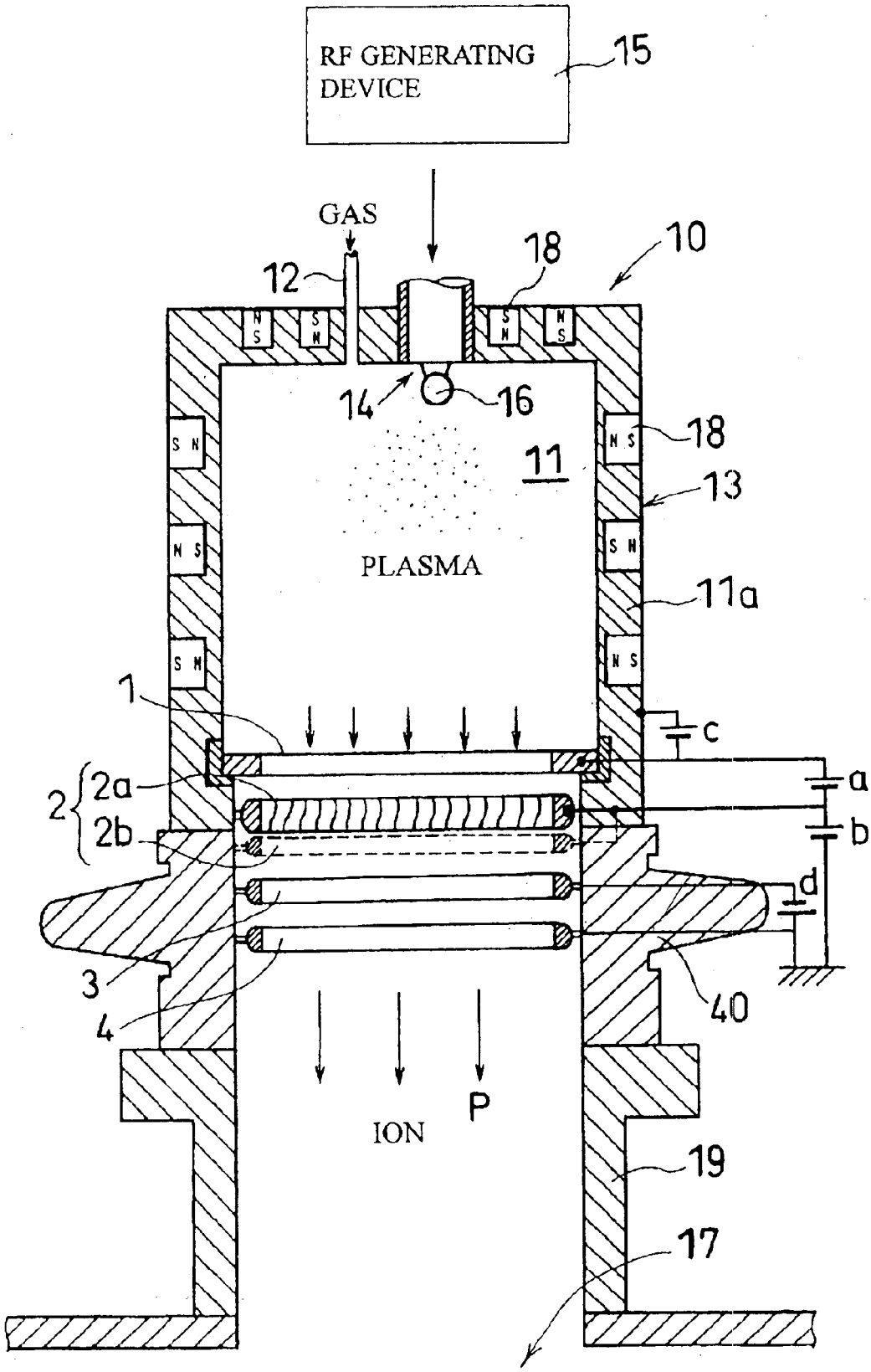
FIG. 1 is a schematic cross-sectional view of an ion source provided with a mass separation device according to the present invention.
Figure 2:
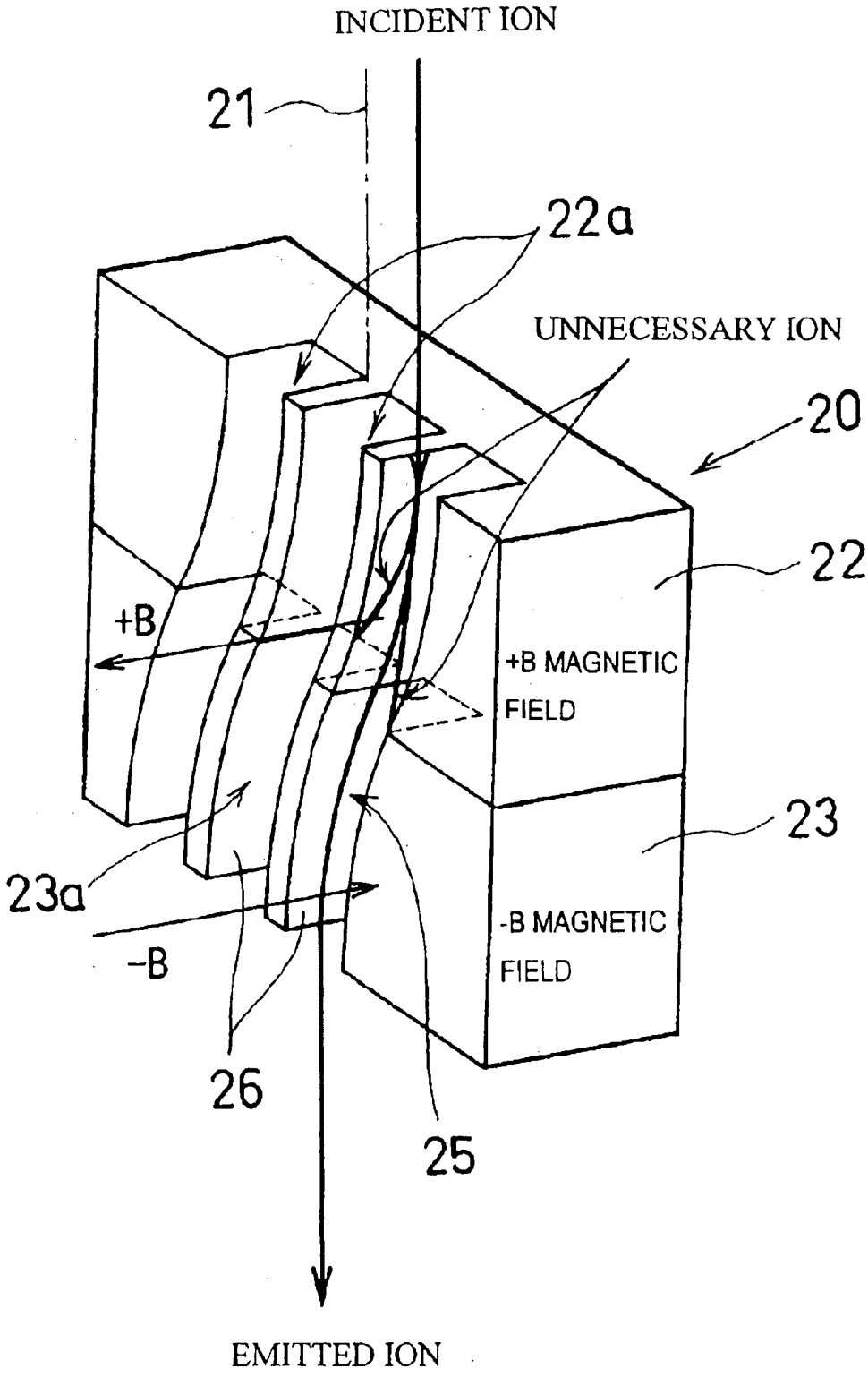
FIG. 2 is a schematic perspective view of an electrode structure in the mass separation device of the present invention.
Figure 3:
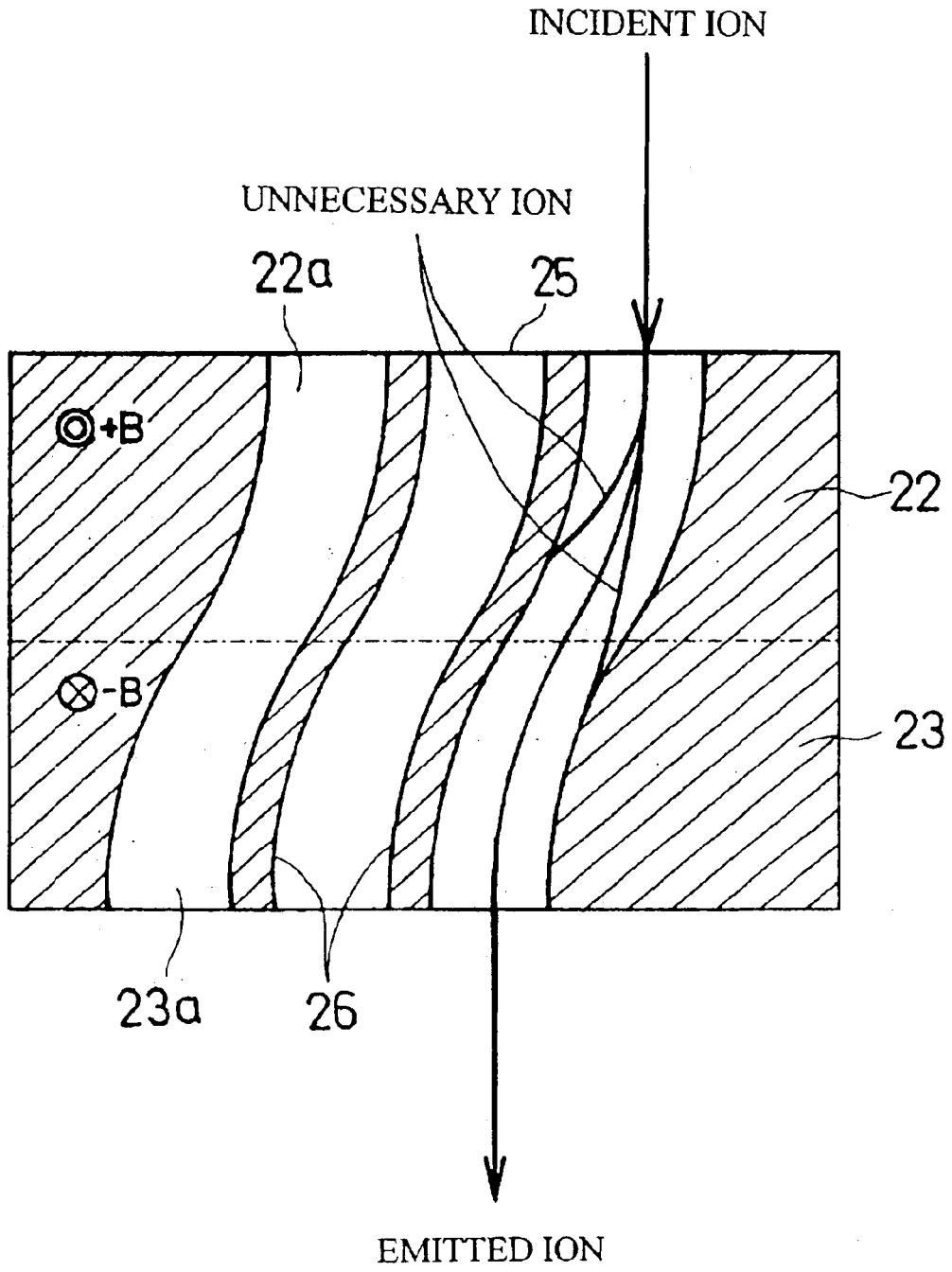
FIG. 3 is a front cross-sectional view of the electrode structure of FIG. 2.

Embodiments of the present invention will be described with reference to the accompanying drawings. FIG. 1 is a schematic cross-sectional view of an ion source 10 using a mass separation filter according to the present invention; and FIGS. 2 and 3 are a schematic perspective view showing the basic structure of a mass separation filter 20 according to the present invention in the ion source and a front view thereof.

Figure 8A:
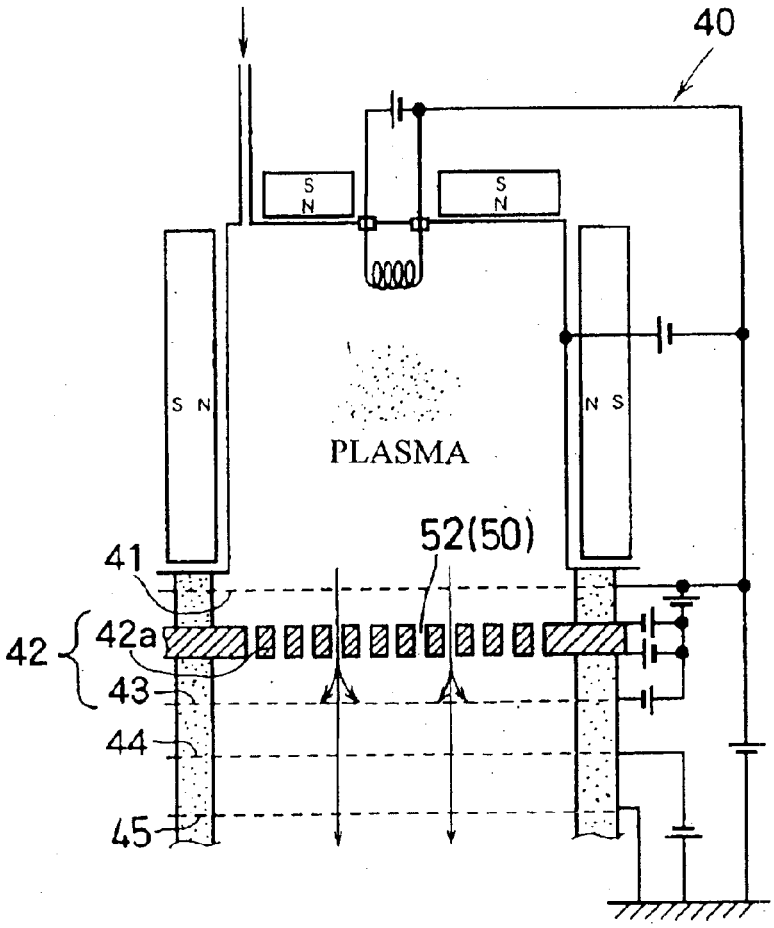
Fig. 8A Prior Art
FIG. 8A is a cross-sectional view of an ion source provided in another conventional mass separation device.
Figure 8B:
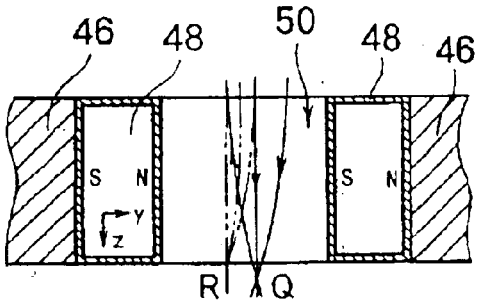
Fig. 8B Prior Art
FIGS. 8B and 8C are vertical and horizontal cross-sectional views showing an arrangement relation between magnets and through holes arranged on the extraction electrode of FIG. 8A.
Figure 8C:
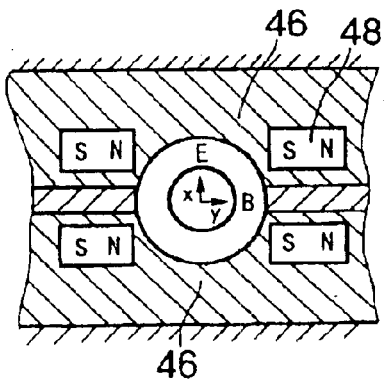
Fig. 8C Prior Art

In FIG. 1, the ion source 10 of the present invention is for extracting a ribbon beam effective for implanting ions in work with a large surface area. As in the case with a conventional device, for example, as shown in FIG. 8A, five porous plate electrodes 1 to 4 are provided at an exit of the ion source 10. A plasma chamber 11 of the ion source exhausts an emission to a vacuum, and is designed such that gas to be ionized can be led from a gas inlet 12. Accordingly, the gas inlet 12 and an exciter 14 are provided in a top wall of the plasma chamber 11.

When this exciter (energy source) 14 is excited, ion source gas supplied from the gas inlet 12 is ionized and forms plasma. In this example, the exciter 14 uses an RF antenna 16 that ionizes electrons with a radio frequency signal from an RF generating device 15, however, forming a tungsten filament that discharges electrons by thermionic discharge is also possible.

A magnet 18 for creating a cusp magnetic field is provided on an outer wall of the plasma chamber 11. Although an example of a packet-type ion source is illustrated in this embodiment, the present invention may be identically applied to other ion sources.

In sequential order from the top, a porous plate electrode is structured from a plasma electrode 1, an extraction electrode 2, an acceleration electrode 3 or a suppression electrode, and a ground electrode 4. The extraction electrode 2 consists of a mass separation electrode 2*a* and a post-extraction electrode 2*b*. The mass separation electrode 2*a* and the post-extraction 2*b* may be arranged such that a forward/rear relation thereof becomes reversed. Also, the mass separation electrode 2*a* may be built in the acceleration electrode 3 or the ground electrode 4. These electrodes are arranged mutually parallel, and constituted by porous plates having respective pluralities of slit holes (see FIG. 4) 6. Individual slits 6*a*, 6*b*, 6*c*, 6*d*, and 6*e*, which are ion through holes, are arranged such that they correspond to a direction P in which the ions travel.

The plasma electrode 1 extracts only positive ions from within the plasma, and is created from soft magnetic iron for magnetic shields in order to reduce the magnetic field penetrating within the plasma. Variable DC power sources a and b are connected between the plasma electrode 1 and a ground. A variable DC power source c is connected between the plasma electrode 1 and a plasma chamber wall 11*a*. Accordingly, the plasma electrode 1 becomes a high potential with respect to the ground, and a lower voltage than the plasma chamber 11. The extraction electrode 2 is a lower potential than the plasma electrode 1 due to the power source a, and the mass separation electrode 2*a* and the post-extraction electrode 2*b* maintain the same potential.

An example relating to voltage distribution will be given. If the plasma electrode is set to 10 kV, the potential of the extraction electrode is 9.9 to 9.6 kV, the potential of the mass separation electrode is 9.7 to 8 kV, the potential of the acceleration electrode is −0.5 to −1 kV, and the ground electrode is 0 kV. In short, the ions have low energy and a delayed speed until they reach the mass separation electrode 3. When the potential of the plasma electrode changes, the potential of the mass separation electrodes and others also changes accordingly. The extraction electrode 2 is rearward of the plasma electrode 1, and works to extract ions from an ion through hole of the plasma electrode 1. This point is identical to a conventional device.

The acceleration electrode 4 is called an acceleration electrode because of a higher voltage acting in the direction to accelerate the ions with respect to the plasma electrode 1, due to a power source d. In actuality, the acceleration electrode 4 maintains a negative charge with respect to a ground, in order to prevent a reverse flow of electrons towards the plasma chamber 11 generated by ions colliding with a target.

The ground electrode 5 is grounded. No electric field is present between the ground electrode 5 and the target (not shown), therefore the ions achieve uniform motion. Ions accelerate between the extraction electrode 2 and the acceleration electrode 4. In particular, strong acceleration occurs between the post-extraction electrode 2*b* and the acceleration electrode 4.

A processing chamber 17 that processes process materials such as semiconductor wafers is connected with the plasma chamber 11 via a connecting chamber 19. An insulating body 40 such as an insulation bushing electrically insulates between the connecting chamber 19 and an ion source housing 13 that surrounds the plasma chamber 11. This insulating body 40 insulates the ion source housing 13 from necessary excitation voltage. This excitation voltage excites ions within the plasma chamber, and accelerates ions emitted from this chamber.

In the ion source of the present invention, extraction voltage supplied to the extraction electrode is automatically adjusted such that the amount of necessary ions will be maximized with respect to the amount of unnecessary ions present within the filter. Control in this case will be executed by obtaining a dose amount from the ion beam through direct beam measurement. Also, extraction voltage using DC voltage with small AC components added that temporally change in order to uniform the ion beam enables the improvement of uniformity in the ion beam.

In such an ion source 10, the mass separation filter 20 of the present invention is generally provided in the extraction electrode 2, and as shown in FIGS. 2 and 3, includes a first magnet 22 forming a first magnetic field +B in an orthogonal direction to a beam axis 21 of the ion beam, and a second magnet 23 sequentially arranged with the first magnet 22 along the beam axis 21 to form a reversed second magnetic field −B parallel to the first magnetic field +B and orthogonal to the beam axis 21. Ions enter the extraction electrode 2 along the beam axis 21 after passing the plasma electrode 1 in the area formed by the first and second magnetic fields. At first, these ions are deflected along a first curved channel 22*a* due to the first magnet 22.

With regard to this deflecting amount, in a uniform magnetic field, ion particles have a circular motion, and the ion beam establishes the relationship, $$R=144\ (mE)^{1/2}*(1/B) \quad (1)$$

where m is the ionic mass, E (eV) is the ionic acceleration energy, r (cm) is the orbital radius, and B (gauss) is the magnetic flux density.

Next, ions passing within the magnetic field of the first magnet 22 enter the magnetic field of the second magnet 23, therefore, now the ions move along a second curved channel 23*a* that curves in a direction opposite to the first magnetic field +B. In this case as well, the above formula (1) is established, and a beam channel 25 including the first and second curved channels is formed.

Ions passing the plasma electrode 1 and entering the first magnet of the mass separation electrode 2*a* are affected by the first magnet field +B orthogonal to the beam axis 21, and slant along a circular trajectory according to the above formula (1). Therefore, ions that are lighter or heavier than ions of a desired mass have different circular trajectories due to a difference in mass thereof, and collide with side walls of the curved channel, i.e. collimator walls 26. Further, an identical situation occurs with the second magnet 23, where ions curve within the curved channel due to the effect of the second magnetic field −B in the opposite direction, and only ions of a desired mass are deflected along the first and second curved channels 22*a* and 23*a*, thereby able to pass through the beam channel 25 without colliding into the collimator walls 26.

Accordingly, similar to allowing ions of a desired mass to pass through this beam channel 25, it is possible to selectively eliminate unnecessary ionic species and allow only selected ions of a desired mass to pass by setting the curvature of the curved channels. The collimator walls (see FIG. 4*a*) shown in an embodiment of the present invention includes a side wall 29*a* consisting of a magnet, a cover thereof, and the like, in addition to curved walls 26. A minimum structure of the collimator walls consists of a pair of curved walls and a pair of side walls, forming a beam channel in which a curved passage encloses these wall surfaces.

In the present invention, the collimator walls 26 of a shape conforming to the curve of this beam channel 25 are formed within the first and second magnetic fields. The collimator walls 26, as shown in FIG. 2, can be formed as, for example, a groove with an S-shape, within the first and second magnets 22 and 23, or as shown in FIG. 4A, may be a structure arranged in sequential predetermined spaces between sets of the first and second magnets 22 and 23, with curved plates arranged in a row along a line at regular intervals between sets of first and second magnets.

In addition, as long as the traveling direction of the incident ions and emitted ions is the same direction as the beam axis, the vertical alignment of each magnetic pole of the first and second magnets 22 and 23 may be reversed, and the shape of the beam channel may be structured with the collimator walls having a reversed S-shape. Further, in the embodiment, the size of the first and second magnetic fields is equivalent, however if the directions of the magnetic fields are opposing, then the size of the magnetic fields may also be different. In addition, in the present invention, the first and second magnets forming magnetic fields on both outer sides of side walls of the beam channel are arranged such that different magnetic pole planes are disposed opposite each other. However, when mass separation is enabled by the curved channel of the first magnet, a single magnetic field may be used if selective separation of ions of a desired mass is possible, for example, by adjusting a shift amount between an incidence opening position and an emission opening position of the beam channel.

Figure 4A:
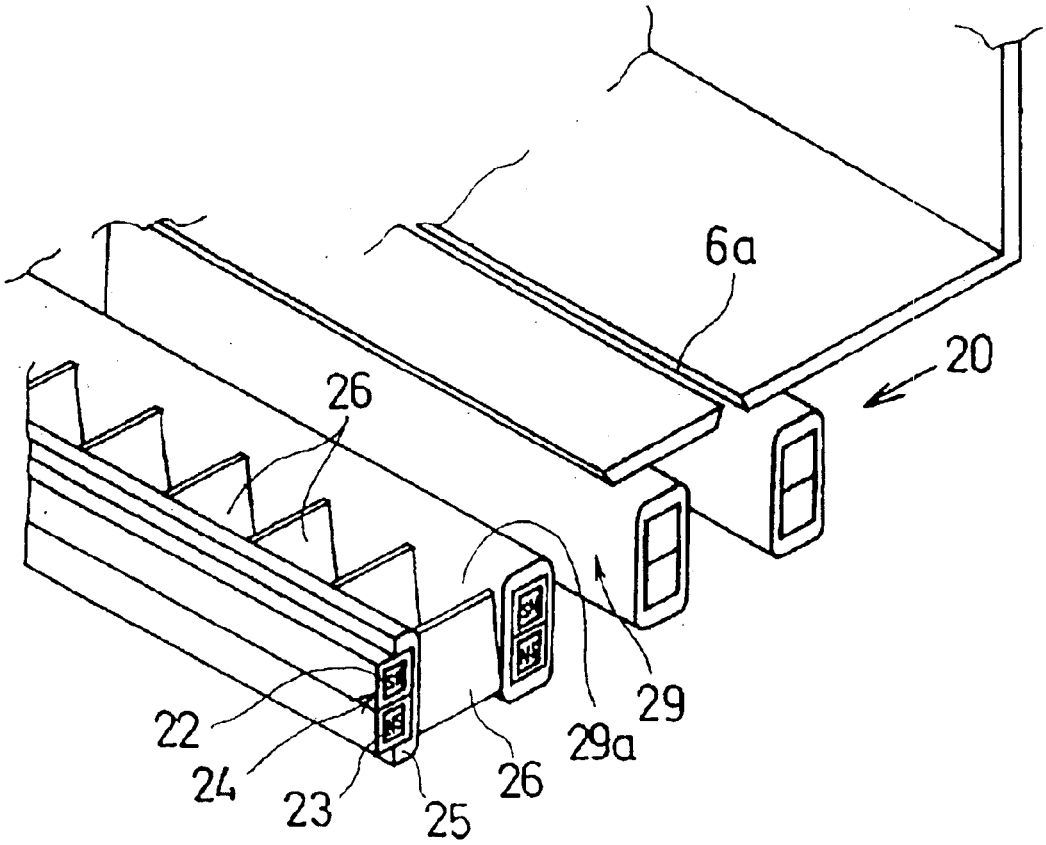
FIG. 4A is a perspective view of the structure of a mass separation filter used in the ion source of FIG. 1.

FIG. 4A is a specific example of the mass separation filter 20 of the present invention, and a perspective view of the mass separation filter built in the extraction electrode 2 placed below the plasma electrode 1. In addition, FIG. 4B is an expanded side view of the arrangement of five electrode structures in an ion source of the present invention shown in FIG. 1.

Figure 4B:
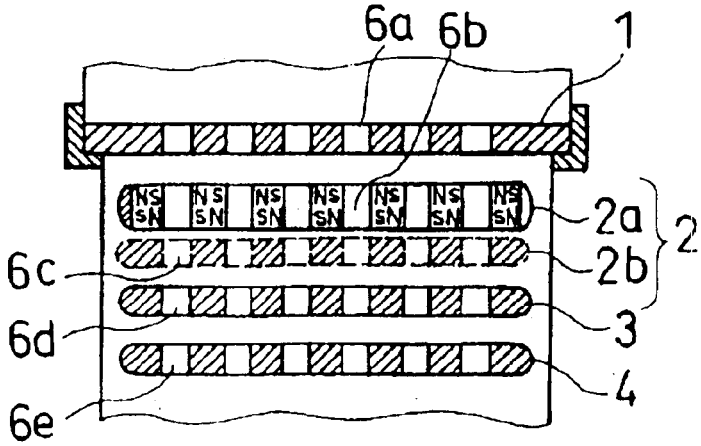
FIG. 4B is a side view of five electrode plates shown in FIG. 1.

In FIG. 4B, ion through slits 6*a*, 6*b*, 6*c*, 6*d*, and 6*e* of the plasma electrode 1, the extraction electrode 2, the mass separation electrode 3, the acceleration electrode 4, and the ground electrode 5 conform to an axial direction, however, diameters and lengths thereof are generally different. In particular, the hole of the mass separation electrode 3 is smaller. Also, a distance at least twice as long as the gap between the first and second magnets is preferable from the plasma electrode to the plane of incidence of the mass separation filter. Providing the mass separation filter of the present invention in the low potential extraction electrode is preferable, however, it is also possible to mount it in either the acceleration electrode or the ground electrode.

The mass separation electrode 2 in an extraction electrode according to the present invention is aligned with the space of the slit 6*a* of the plasma electrode 1, and a plurality of first and second magnet sets are sequentially arranged in a line. The first and second magnets 22 and 23 are constituted by pole-shaped permanent magnets extending in an oblong direction, and vertically stacked with magnetic poles (N and S) reversed. The intensity of the first and second magnetic fields is virtually identical, and the second magnetic field has a magnetic flux density deflecting ions by a distance identical to the ionic displacement amount by the first magnetic field.

Figure 5:
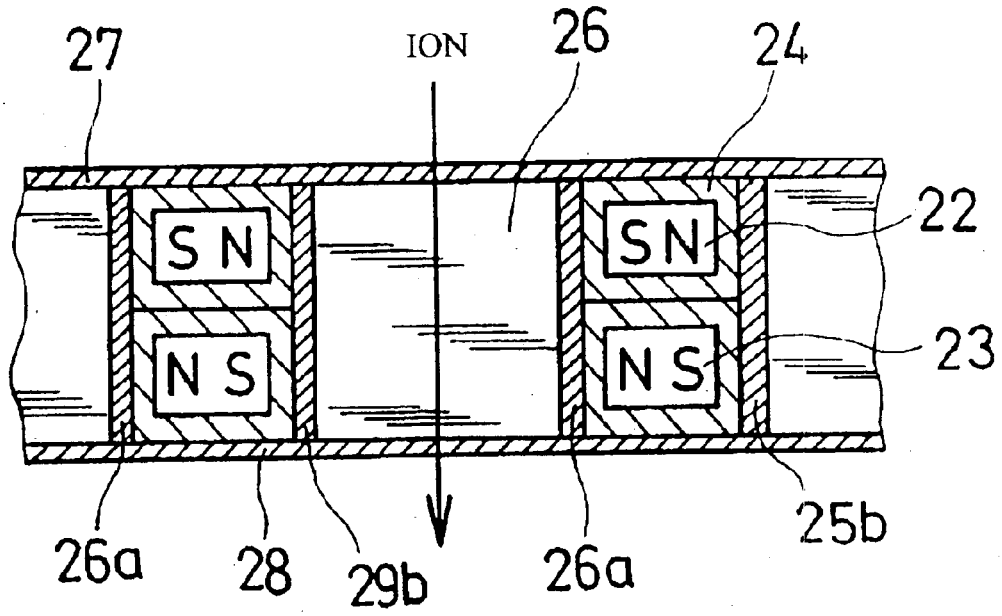
FIG. 5 is a detailed cross-sectional view of the structure of a magnet portion for performing mass separation with an extraction electrode.

In FIGS. 4 and 5, the first and second magnets 22 and 23 are respectively stored within angular metal (stainless steel and the like) metal tubes 24, the outside of which is encompassed by the graphite side wall 29*a*. The collimator walls 26 with substantially S-shaped cross-sections are aligned between these graphite covers 29 at a predetermined space. The set of first and second magnets placed in the collimator walls 26 are disposed such that the respective different magnetic pole planes face opposite each other. Each row of the collimator walls is disposed at a pitch identical to the space of openings (slits) of the plasma electrode. In addition, it is preferable for the thickness of the collimator wall to be a value under 10% of the space between collimator walls.

In an example of the electrode structure in the extraction electrode 2 of the present invention, as shown in FIG. 5, stainless steel tubes 24 that respectively accommodate the first and the second magnets are provided between an entrance wall 27 and an exit wall 28. A connecting end portion 26*a* of the collimator wall 26 is disposed on a side wall of this metal tube, and a graphite bridgewall 29*b* is provided on another side wall. Thus, with each paired set of magnets, it is possible to extract each paired set of magnet for each metal tube. Further, each collimator wall 26 is assembled into one via the connecting end portions 26*a*, therefore, it is also possible to integrally take the collimator walls 26 that are aligned in a row out to the front of the extraction electrode 2, as well as the magnet sets, rendering it easy to disassemble and attach each component.

Figure 6:
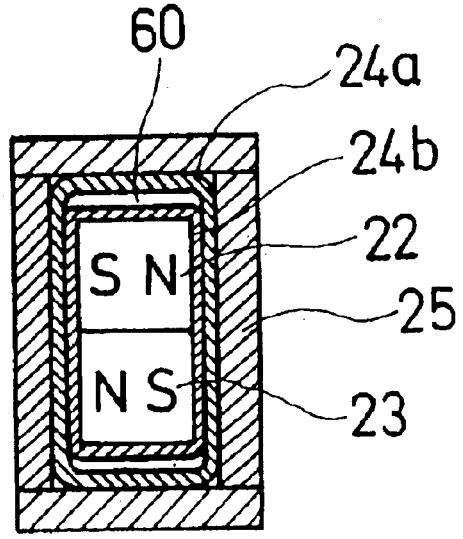
FIG. 6 is a cross-sectional view of the structure of a magnet portion in another embodiment.
Figure 7:
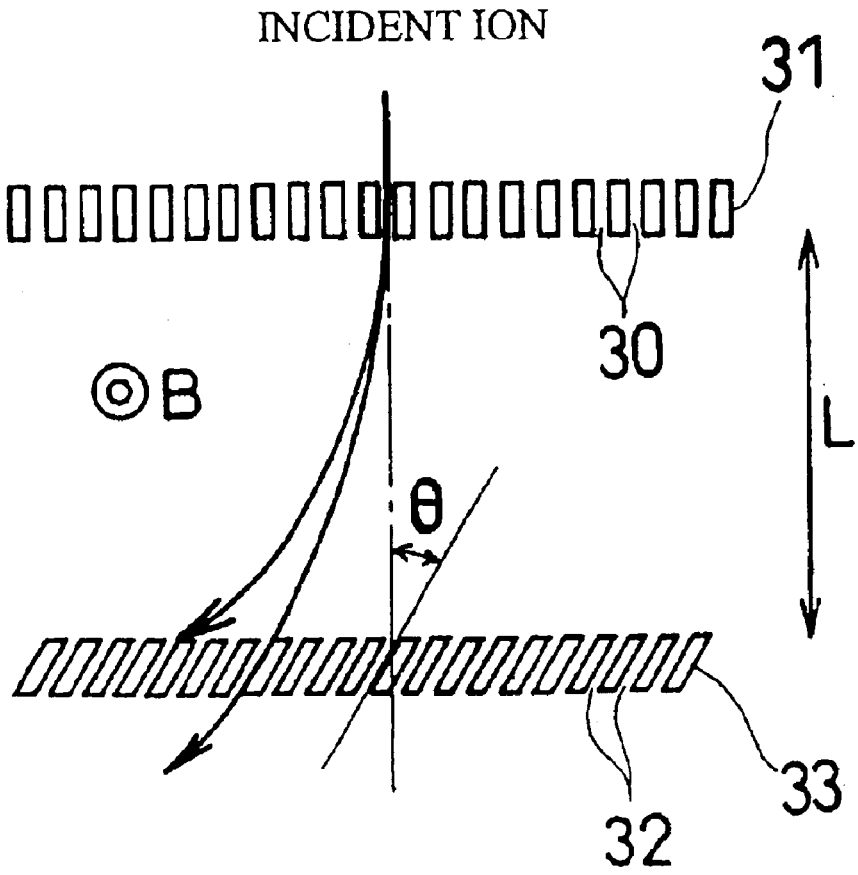
Fig. 7 Prior Art
FIG. 7 is a schematic view of an electrode arrangement in a conventional mass separation device.

The first and second magnets 22 and 23, as shown in FIG. 6, may have a shape in which the two magnets 22 and 23 are in vertical contact and stored in one metal tube 24. In addition, it is preferable that this metal tube 24 is constituted by double metal tubes 24*a* and 24*b*, and is designed such that coolant passes through a space between the tubes.

The above description illustrates an example of the present invention. However, the present invention is not limited to the aforementioned embodiments, and various reconfigurations, modifications and alterations are possible relating to the above description as long as they are regarded as within the scope of the present invention as set by the scope of the claims and an equivalent construction thereof.

What is claimed is:

1. A mass separation filter of an ion beam comprising:

a first magnet forming a first magnetic field in a direction orthogonal to a beam axis of an ion beam;

a second magnet sequentially provided with the first magnet along the beam axis, and forming a second magnetic field which is parallel with and opposite the first magnet field as well as orthogonal to the beam axis; and a collimator wall for forming a beam channel having a first and a second curved channels formed within the first and second magnetic fields such that selected ions of a desired mass can pass from the first curved channel deflected by the first magnetic field to the second curved channel which is deflected in a direction in the reverse of the first magnetic field by the second magnetic field.

2. The mass separation filter according to claim 1, wherein a direction of incident ions and a direction of emitted ions are identical to a direction of the beam axis.

3. The mass separation filter according to claim 1, wherein an intensity of the second magnetic field is virtually identical to an intensity of the first magnetic field, and has a magnetic flux density that deflects only a distance identical to an ionic displacement amount by the first magnetic field.

4. The mass separation filter according to claim 1, wherein the first and the second magnets are permanent magnets.

5. The mass separation filter according to claim 1, wherein the first and second magnets are provided in the interior of a metal tube through which coolant flows.

6. The mass separation filter according to claim 1, wherein the collimator wall includes at least one pair of curved walls and one pair of side walls provided facing each other to form the first and second curved channels.

7. The mass separation filter according to claim 6, wherein the first and second magnets are provided on both outer sides of the pair of side walls and arranged such that their respective different magnetic pole planes are opposed.

8. The mass separation filter according to claim 1, wherein the first curved channel and the second curved channel structure a beam channel formed continuously along a beam trajectory.

9. The mass separation filter according to claim 8, wherein the continuous beam channel is provided linearly parallel, and the curved walls structuring each beam channel structure a side of a curved wall of respective adjacent beam channels.

10. The mass separation filter according to claim 1 or claim 6, wherein the collimator wall is made from graphite.

11. The mass separation filter according to claim 1, wherein the collimator wall is made from a thin metal plate.

12. The mass separation filter according to claim 1, wherein the thickness of the collimator wall is a value under 10% of a space between the collimator walls.

13. The mass separation filter according to claim 1, wherein the collimator wall is fixed to a side of a wall surface between opposing magnets.

14. The mass separation filter according to claim 1, wherein the collimator wall has a substantial S-shape created by two joined arcs, and the two arcs are in mutual contact at two joining points, as well as mutually parallel at an end of the collimator wall and parallel to the beam axis.

15. The mass separation filter according to claim 1, wherein the beam axis formed by the collimator wall is a substantial S-shape and not parallel to the magnetic fields.

16. The mass separation filter according to claim 1, wherein the beam trajectory deflected by the first magnetic field and inversely deflected by the second magnetic field is structured such that an emission opening position of the beam is shifted with respect to the incidence opening position of the beam towards the mass separation filter; and the two opening positions do not overlap when viewed from the axial direction of the ion beam such that a forward traveling beam which is not deflected is not directly emitted.

17. The mass separation filter according to claim 1, wherein the beam trajectory deflected by the first magnetic field and inversely slanted by the second magnetic field is structured such that an emission opening position of the beam is shifted with respect to the incidence opening position of the beam towards the mass separation filter; the two opening positions overlap when viewed from the axial direction of the ion beam in order to allow passing of the forward traveling beam.

18. An ion beam mass separation method comprising the steps of:

forming mutually parallel and opposing first and second magnetic fields that are orthogonal to a beam axis of an ion beam from a first and a second magnet sequentially provided along the beam axis; and passing ions of a desired mass within the first and second magnetic fields from a first curved channel slanted by the first magnetic field along a second curved channel slanted in a direction in the reverse of the first magnetic field by the second magnetic field.

19. An ion beam mass separation method comprising the steps of:

forming one or two magnetic fields orthogonal to a beam axis of an ion beam in which the two magnetic fields are mutually opposing and parallel;

deflecting an ion beam within the magnetic fields along a curved channel formed by a collimator wall created from at least a pair of curved walls and a pair of side walls provided facing each other; and passing selected ions of a desired mass while colliding forward traveling ions and unnecessary ions into the collimator wall.

20. The mass separation method according to claim 19, wherein the opposing pair of side walls are provided such that the different magnetic pole planes of the magnets forming the magnetic fields on both sides of the side walls thereof are provided facing each other.

21. A large area ion source comprising:

(a) a plasma chamber;

(b) means for introducing gas with a controlled flow rate into the plasma chamber;

(c) an energy source for ionizing the gas within the plasma chamber;

(d) a plasma electrode that forms a plasma chamber wall with an oblong opening, and extracts positive ions from the opening;

(e) an extraction electrode for setting a controllable value of the kinetic energy of the ions, and provided parallel to and with a low potential with respect to the plasma electrode in order to extract ions passing the plasma electrode; and (f) a mass separation filter provided parallel to the plasma electrode and having a plurality of openings aligned with the extraction electrode in order to select a desired mass or a range of mass; wherein the mass separation filter comprises a first magnet forming a first magnetic field in a direction orthogonal to a beam axis of an ion beam;

a second magnet sequentially provided with the first magnet along the beam axis and forming an inverted second magnetic field orthogonal to the beam axis and parallel to the first magnetic field; and a collimator wall forming a beam channel having a first and a second curved channel formed within the first and second magnetic fields such that selected ions of a desired mass pass from the first curved channel slanted by the first magnetic field along the second curved channel slanted in a direction in the reverse of the first magnetic field by the second magnetic field.

22. The ion source according to claim 21, wherein the mass separation filter is mounted in one of an extraction electrode, an acceleration electrode, and a ground electrode of the ion source.

23. The ion source according to claim 21, wherein the ion beam is a ribbon beam having an oblong cross-section.

24. The ion source according to claim 21, wherein the mass separation filter is provided in parallel between the plasma electrode and the extraction electrode.

25. The ion source according to claim 21, wherein the plasma electrode is made from soft magnetic iron for magnetic shields in order to reduce the magnetic field penetrating the plasma.

26. The ion source according to claim 21, wherein the distance from the plasma electrode to the incidence surface of the mass separation filter is at least double the gap between the first and second magnets.

27. The ion source according to claim 21, wherein the collimator wall has a substantial S-shape created from two joining arcs, and the two arcs are in mutual contact at two joining points as well as mutually parallel at an end of the collimator wall and parallel to the beam axis.

28. The ion source according to claim 27, wherein a curvature radius of an arc is $$R=144\ (mE)^{1/2}*(1/B) \tag{1}$$

when an ionic mass is m, an ionic acceleration energy is E (eV), an orbital radius is R (cm), and a magnetic flux density is B (gauss).

29. The ion source according to claim 21, wherein the collimator wall has a pitch identical to the clearance of the opening of the plasma electrode.

30. The ion source according to claim 21, wherein the first curved channel and the second curved channel are a continuous beam channel formed along a beam trajectory, with a clearance of the arrangement thereof rendered a pitch identical to the clearance of the opening of the plasma electrode.

31. The ion source according to claim 21, wherein the collimator walls are arranged in a row at equal intervals between the sets of the first and second magnets of a rectilinear shape provided at predetermined intervals and conforming to a direction in line with the opening of the plasma electrode.

32. The ion source according to claim 21, wherein an extraction voltage supplied to the extraction electrode is automatically adjusted such that the amount of necessary ions is maximized with respect to the amount of unnecessary ions present within the filter.

33. The ion source according to claim 21, wherein the extraction voltage is a direct current voltage to which a small alternating current component is added that temporally changes in order to uniform the ion beam.

* * * * *